US005094442A

United States Patent [19]

Kamprath et al.

[11] Patent Number: 5,094,442

[45] Date of Patent: Mar. 10, 1992

[54] TRANSLATING ELECTRONIC REGISTRATION SYSTEM

[75] Inventors: David R. Kamprath, East Rochester; Michael A. Malachowski, Webster, both of N.Y.

[73] Assignee: Xerox Corporation, Stamford, Conn.

[21] Appl. No.: 559,336

[22] Filed: Jul. 30, 1990

[51] Int. Cl.[5] ..... B65H 7/02

[52] U.S. Cl. ..... 271/227; 271/236; 271/265

[58] Field of Search ..... 271/227, 228, 241, 236, 271/265

[56] References Cited

U.S. PATENT DOCUMENTS

| | | | |
|---|---|---|---|
| 2,178,304 | 10/1939 | Holness | 271/228 |
| 3,240,487 | 3/1966 | Templeton | 271/228 |
| 3,754,826 | 8/1973 | Kobayashi et al. . | |
| 4,438,917 | 3/1984 | Janssen et al. . | |
| 4,511,242 | 4/1985 | Ashbee et al. | 271/227 |
| 4,518,456 | 4/1978 | Schroter . | |
| 4,518,862 | 5/1985 | Dorn . | |
| 4,726,501 | 2/1988 | Wiley | 271/227 |
| 4,799,084 | 1/1989 | Koike et al. | 271/250 |
| 4,805,892 | 2/1989 | Calhoun | 271/227 |
| 4,811,640 | 3/1989 | Fritsch | 271/228 |
| 4,855,607 | 8/1989 | Eckl | 271/227 |
| 4,971,304 | 11/1990 | Lofthus | 271/227 |

FOREIGN PATENT DOCUMENTS

| | | | |
|---|---|---|---|
| 128146 | 7/1984 | Japan | 271/228 |
| 96246 | 5/1987 | Japan | 271/227 |
| 171750 | 7/1988 | Japan . | |
| 180635 | 7/1988 | Japan | 271/227 |
| 230451 | 9/1988 | Japan | 271/227 |
| 306145 | 12/1988 | Japan . | |
| 34836 | 2/1989 | Japan | 271/227 |
| 81741 | 3/1989 | Japan | 271/228 |
| 214555 | 8/1989 | Japan . | |
| 317938 | 12/1989 | Japan | 271/228 |
| 13539 | 1/1990 | Japan | 271/227 |
| 95640 | 4/1990 | Japan . | |

OTHER PUBLICATIONS

Huggins, R., "Skew Detector and Method of Correction", *Xerox Disclosure Journal*, vol. 14, No. 1, Jan/Feb. 1989, pp. 23-24.

*Primary Examiner*—Robert P. Olszewski
*Assistant Examiner*—Steven M. Reiss
*Attorney, Agent, or Firm*—Oliff & Berridge

[57] ABSTRACT

Position registration of sheets in a feed path is achieved without guides or gates. Laterally separated drive rolls are speed controlled to correct for skew mispositioning. Lateral registration is achieved by translation of the drive rolls transversely to the direction of sheet movement. Longitudinal registration is controlled by varying the speeds of the drive rollers equally. The system reduces the required paper path length to achieve correct registration, thereby allowing higher speed operation.

19 Claims, 3 Drawing Sheets

TRANSLATING ELECTRONIC REGISTRATION SYSTEM

BACKGROUND OF THE INVENTION

1. Field of the Invention

This invention relates to positioning of sheets in a feed path. It particularly relates to positioning sheets of paper in a feed path for subsequent processing such as electrophotographic reproduction.

2. Description of the Related Art

Conventional sheet aligning mechanisms for equipment using paper feed stocks, such as electrophotographic reproduction equipment, use crossed nip rollers in conjunction with fixed guides and gates for positioning paper. Such systems commonly use sheet driving rolls which push the sheets against such guides and gates. These conventional systems have many drawbacks. If the guide and gate surfaces with excessive force, the edges of the sheets can be bent or crumpled. This condition occurs especially with lightweight papers and causes problems in downstream feeding of the paper. Thus, each system must be carefully set up for a narrow range of paper weight to provide sufficient drive force for movement of the sheet without damaging the sheet as it is driven against a guide or gate. In addition, undesirable dust is formed as a result of the impact and sliding of the paper against the hard guide surfaces. Further, duplex copying requires an additional station to shift the sheet laterally before it is returned to the cross roll feeder for re-feeding, so that the sheet can be realigned by the cross roll feeder against the guide. In addition, such systems are prone to drive roll slippage which can cause misregistration and smearing.

Sheet guide systems for shifting the lateral position of the guide have been proposed and are shown in U.S. Pat. Nos. 4,799,084 and 4,805,892. However, these systems do not provide for skew adjustment of the sheet and do not gate the sheet for downstream operations.

Belt-type feeders with variable edge distancing have been proposed for providing skew correction of sheets. Such designs are shown in U.S. Pat. Nos. 3,754,826 and 4,082,456. However, such arrangements do not provide precise lateral and longitudinal positioning of the sheet.

Sheet aligners without guides, using drive rollers for sheet alignment have also been proposed. One such design is disclosed in U.S. Pat. Nos. 4,438,917 and 4,511,242. However, this design has several drawbacks including the need for initially feeding sheets at a significant skew angle to the aligning rolls and sensor system. This unduly complicates the feeding system and requires a longer feed path to achieve sheet alignment. This has an adverse effect on the speed at which the aligner can perform its function and limits its capacity. In addition, the longer feed path results in an overall increase in the size of the equipment. Further, the electronic control systems required for this design are relatively complex and costly.

OBJECTS AND SUMMARY OF THE INVENTION

It is an object of this invention to improve apparatus for aligning sheets in a feed path.

It is further an object of the invention to provide high speed alignment without the use of edge guides or gates.

It is further an object of the invention to minimize the space requirements of apparatus for aligning sheets in a feed path.

It is also an object of the invention to provide for top edge registration of sheets without the need for offsets, canted transports or staggered feeders.

It is another object of the invention to provide a sheet aligner capable of aligning sheets having a wide range of weights and thicknesses.

These and other objects are achieved, and the shortcomings discussed above are overcome, by a registration system having two nip rolls for driving the sheet, at least one of the rolls having a controllable drive which can vary the speed of the associated nip roll with respect to the other nip roll. Sensors are provided for detecting skew of the sheet to control the variable speed motor. Alternately, the speed of both nip rollers is controllable to effect skew alignment and longitudinal gating. The nip rollers are mounted on a carriage movable transversely with respect to the feed path. A sensor system controls positioning of the carriage to achieve the desired top edge or a lateral positioning of the sheet. Independent control of nip roll drive and carriage translation provides simultaneous alignment in lateral and longitudinal directions.

BRIEF DESCRIPTION OF THE DRAWINGS

The invention will be described in detail with reference to the following drawings in which like reference numerals refer to like elements and wherein.

DESCRIPTION OF THE PREFERRED EMBODIMENT

Figure 1:
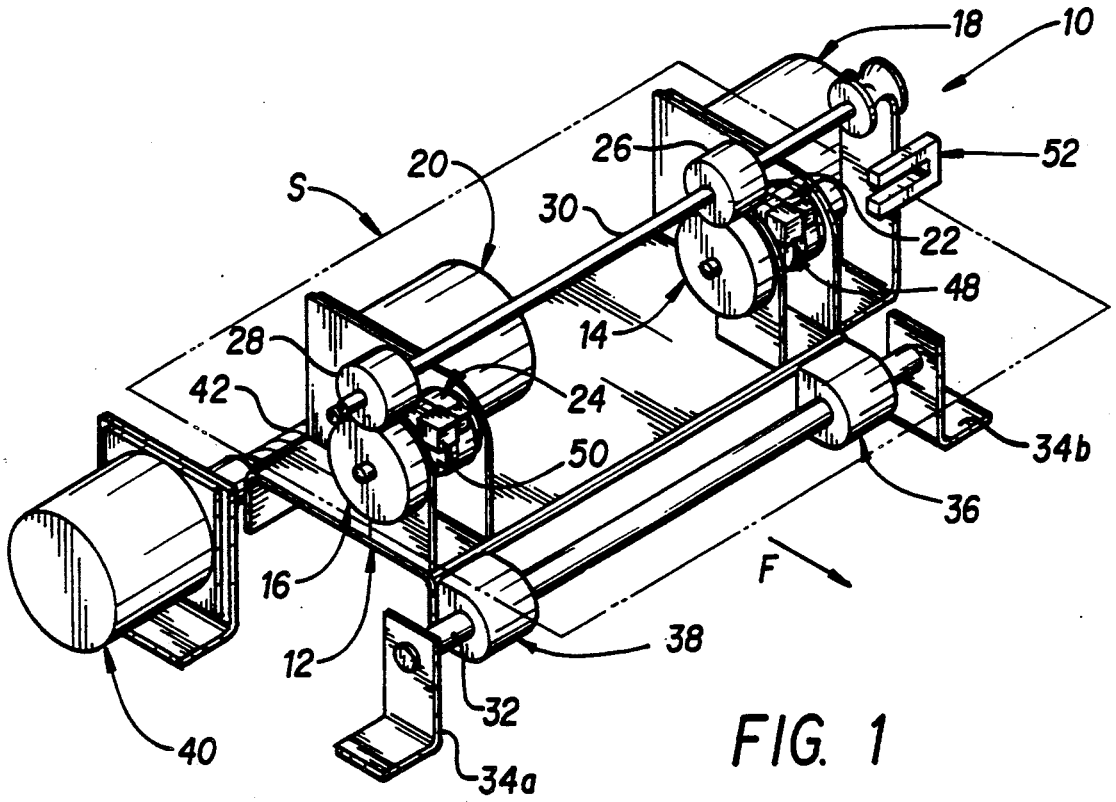
FIG. 1 is an isometric view of a sheet registration system in accordance with the invention.

FIG. 1 illustrates one embodiment of a sheet registration system in accordance with the invention. The system places a sheet S into proper alignment or registration for downstream processing as the sheet travels in the direction shown by arrow F. The registration unit 10 includes a carriage 12 having two drive rolls 14 and 16 rotatable mounted thereon by suitable means. The drive rolls 14 and 16 are driven by drive motors 18 and 20, respectively. The drive motors 18 and 20 are preferably speed controllable stepper motors, although other types of speed controllable servo motors are usable. The rotary output of each motor 18, 20 is transmitted to the respective drive roll 14, 16 by suitable power transmission means, such as belts 22, 24.

Above drive roll 14 there is rotatably mounted by suitable means a nip roll 26. A similar nip roll 28 is mounted above drive roll 16. Advantageously, the nip rolls 26 and 28 are commonly coaxially mounted for rotation about the axis of a cross shaft 30, which is mounted on the carriage 12. The roll pairs 14, 26 and 16, 28 engage the sheet S and drive it through the registration unit 10.

The carriage 12 is mounted for movement transversely of the direction of feed indicated by arrow F. In the arrangement of FIG. 1, this is accomplished by mounting one edge of the carriage 12 on the guide 32, which extends perpendicularly to the direction of sheet feed. The guide 32 is supported on the frame on which the registration system is mounted by a pair of opposed supports 34*a* and 34*b*. The carriage 12 is mounted on the guide 32 by a pair of bearings 36 and 38, which are slidably received on the guide 32.

Figure 2:
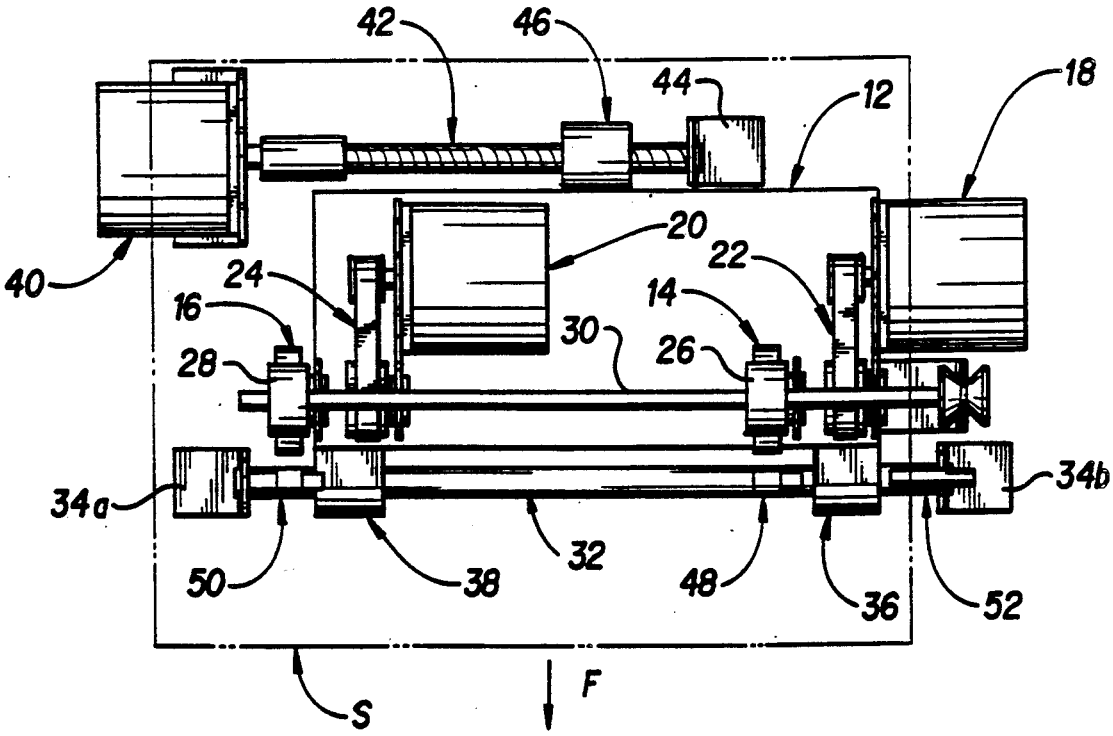
FIG. 2 is a top plan view of the sheet registration system shown in FIG. 1.

Referring to FIG. 2, the carriage 12 is moved transversely of the feed path by a drive system including a speed controllable stepper motor 40 or other similar speed controllable servo motor. The output shaft of the motor 40 drives a lead screw 42 which is rotatably supported at the end opposite the motor by a suitable bearing support 44. The motor 40 and support 44 are mounted on the frame of the equipment in which the registration system is used. A block 46 having an internally threaded bore is mounted on the carriage. The threads of the internal bore of the block 46 engage the threads of the lead screw and it will be readily appreciated that as the motor 40 rotates the lead screw 42, the carriage will be driven transversely as the block 42 travels along lead screw 42. The direction of rotation of motor 40 governs the direction of movement of the carriage 12.

Referring again to FIG. 1 the registration system includes detectors for detecting the position of the sheet with respect to the registration system. Preferably, the detectors are optical detectors which will detect the presence of edges of the sheet S. For lead edge detection of the sheet, two detectors 48 and 50 are mounted on the carriage 12 adjacent the drive rolls 14 and 16 respectively. The detectors 48 and 50 detect the leading edge of the sheet S as it is drive past the sensors. The sequence of engagement of the sensors 48 and 50 and the amount of time between each detection is utilized to generate control signals for correcting skew (rotational mispositioning of the sheet about an axis perpendicular to the sheet) of the sheet by variation in the speed of the drive rolls 14 and 16.

A top or lateral edge sensor 52 is suitably mounted by means (not shown) on the frame of the equipment on which the registration system is mounted. This optical detector is arranged to detect the top edge of the sheet and the output therefrom is used to control transverse drive motor 40. The basic logic of operation provides that, if the sensor 52 is covered by the sheet, the motor 40 will be controlled to move the carriage to the left (FIG. 1). If, on the other hand, one of the sensors 48, 50 indicates the presence of the leading edge of the sheet, and if sensor 52 remains uncovered, then the motor 40 is drive to move the carriage 12 rightwardly. In the preferred arrangement, the carriage is driven past the transition point, at which the lateral edge of the sheet is detected by the change of state of the sensor 52. Then the drive is reversed to position the lateral edge at the transition point.

Figure 3:
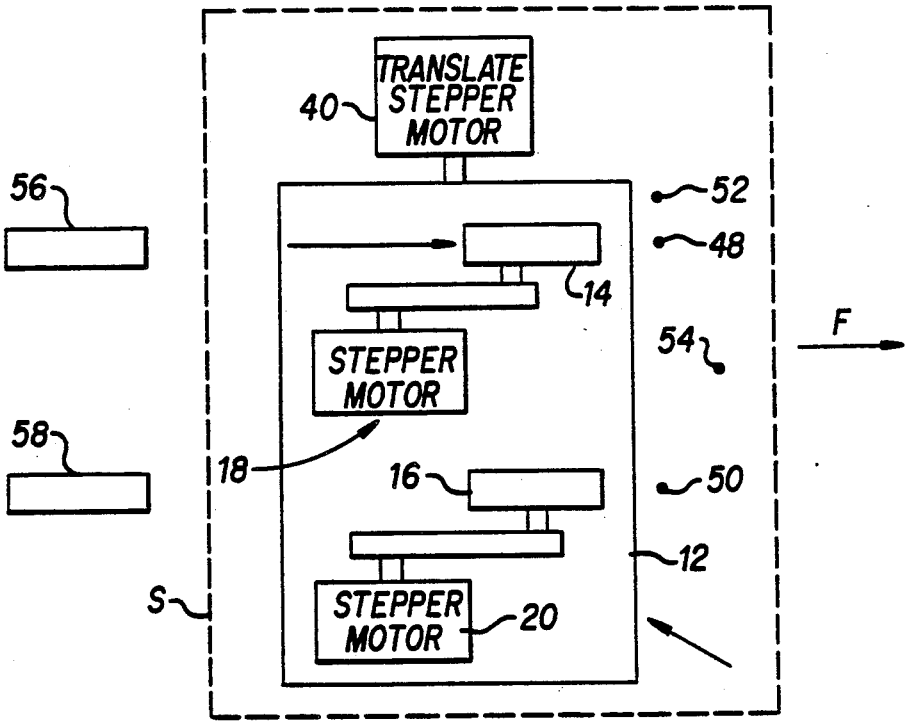
FIG. 3 is a schematic illustration of a sheet positioner showing the placement of sheet location sensors.
Figure 4:
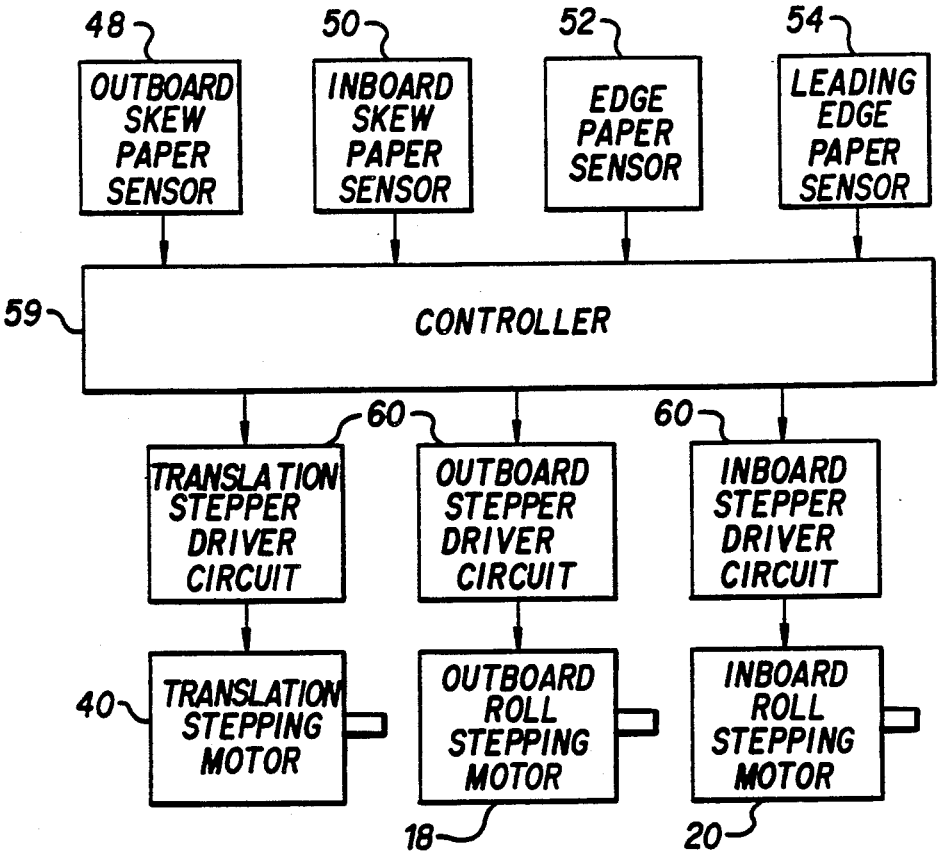
FIG. 4 is a block diagram of control circuitry for one form of sheet registration system.

FIG. 3 is a schematic illustration of a top view of a registration system showing the positioning of the sensors. This arrangement shows a fourth sensor 54, which may be an optical sensor, mounted in the feed path of the sheet S to detect the position of the lead edge of the sheet. The arrival time of the leading edge of sheet S at sensor 54 is compared with a reference signal, for example one occurring after skew correction is complete, to derive a process direction error correction value. This value is compared with a desired value and the velocity of the two drive rolls 14 and 16 is temporarily increased or decreased so that the leading edge of the sheet reaches a desired point in the feed path in synchronization with a downstream operation. In this fashion, the registration system performs a gating function. In high speed systems, particularly ones for handling large sheets of paper, it is desirable to employ releasable nip rolls 56 and 58. These rolls drive the paper to the point where the registration system begins making adjustments to the position of the paper. At that point, the rolls 56 and 58 are released so that the sheet is free to be moved under the influence of drive rolls 14 and 16 and the translating carriage 12. Such releasable nip roll arrangements are known in the art and no further explanation thereof is necessary.

For the control of the registration system disclosed above, control systems having the arrangement shown in FIGS. 1–4 are desirable. Signals from the edge sensors 48, 50, 52 and, alternatively sensor 54, are provided to a controller 59. In a preferred arrangement, sensors 48 and 50 are utilized for both skew correction and longitudinal gating. In an alternative arrangement, if higher speed or accuracy is necessary, it may be desirable to employ a fourth sensor 54, for deriving signals necessary for longitudinal gating.

The controller 59 can be a typical microprocessor which is programmed to calculate correction values required and provide control outputs for effecting appropriate action of the stepper motors 18, 20 and 40. Such microprocessor control systems are well known to those of skill in the art and no detailed description thereof is necessary. Outputs of the microprocessor are provided to driver control circuits 60, for controlling speeds and duration of drive of stepper motors 18, 20, and 40. Suitable driver control circuits are known in the art and no further detailed explanation is necessary.

Although the foregoing description has been in the context of a registration system having two separately and independently drivable motors 18 and 20 for the drive rolls 14 and 16, it is possible to obtain skew correction with this design by the use of a single speed controllable drive roller used in conjunction with a drive roll driven at a constant speed. For example, the drive roll 14 could be driven through a suitable drive transmission, such as a belt or gear train from the main drive motor of a copier, at a constant speed. Skew correction can be achieved by varying the speed of the second drive roll with respect to the constant velocity drive roll. Such a system is particularly useful in situations where the registration system does not have to provide lead edge gating. The advantages of quick skew correction and lateral edge correction are maintained, while the cost of the unit can be reduced by elimination of one of the variable speed drives.

Figure 5:
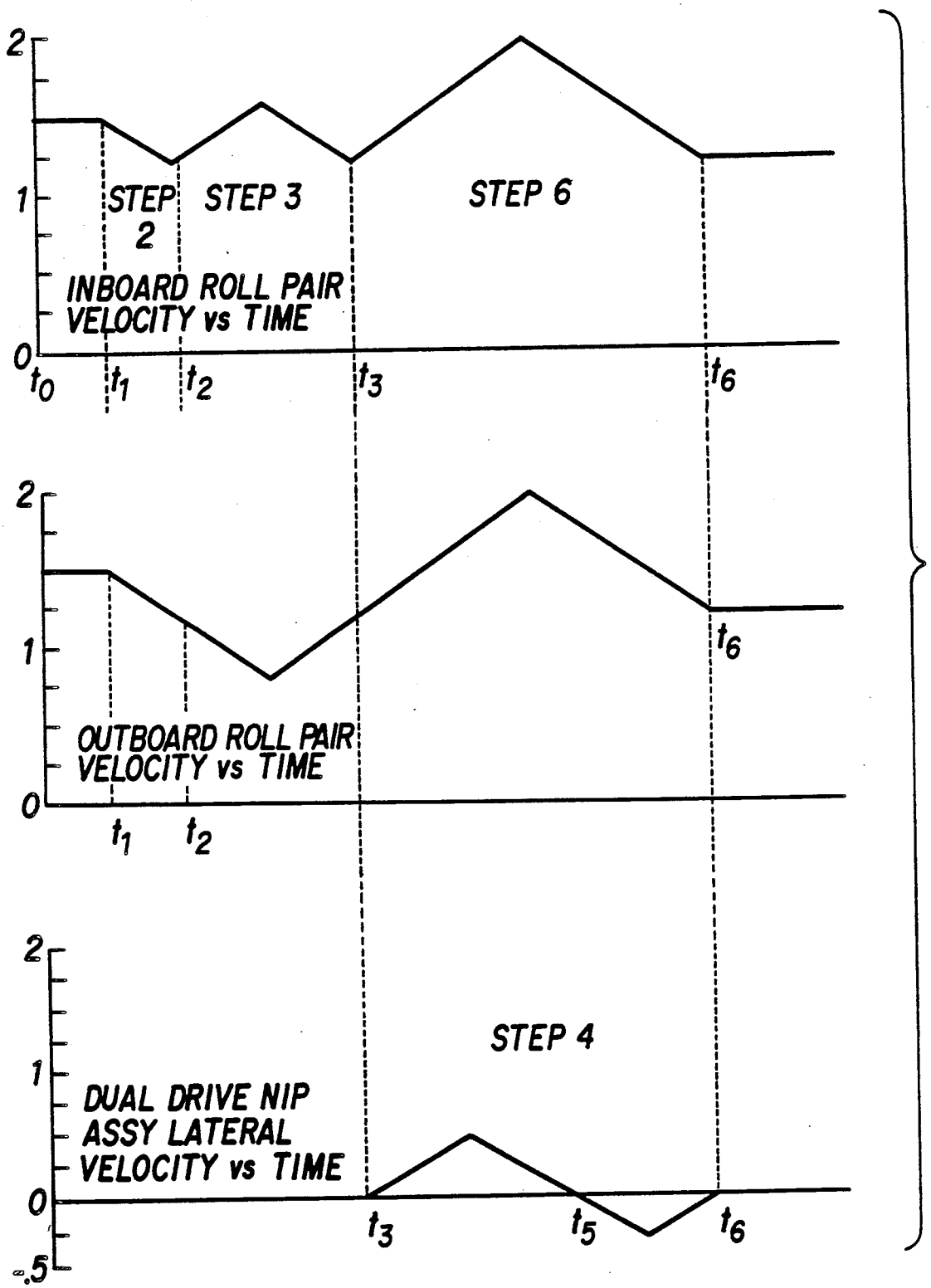
FIG. 5 shows typical motion profiles for the drive rolls and translating carriage.

Referring to FIG. 5, a typical operating sequence for the registration system will now be described. For purposes of this analysis, the roll drive and translation motion are all assumed to take place with constant accelerations. From point $t_0$ to $t_1$, the drive rolls 14 and 16 are both being driven at the same constant speed. Time $t_1$ represents the time at which skew sensor 48 and 50 first detects the leading edge of the sheet S. The controller uniformly decreases the speed of both drive rolls 14 and 16 during the period $t_1$–$t_2$. Thereafter, depending upon the direction of skew detected by sensors 48 and 50, the speed of roll 16 is increased (as shown in FIG. 5) or decreased during the period of time $t_2$–$t_3$, while the speed of roll 14 is correspondingly decreased (as shown in FIG. 5) or increased in the same time period. Preferably, the speed variation curves are substantially symmetrical. By the time $t_3$, the skew position of the sheet has been corrected by the differential speeds of rolls 14 and 16. Also, the position of the leading edge of the paper is determined by controller 59 based on the initial position detection by sensors 48, 50 and the control inputs to rollers 14 and 16, or, alternatively by sensor 54 sensing the leading edge of the sheet. The speed of rolls 14 and 16 is than uniformly changed (for example, increased as shown in FIG. 5) during the period $t_3$ to $t_6$ so that the leading edge of the sheet is in registration with a desired point in the feed path to provide synchronization of the sheet for feeding into a downstream operation. At the time $t_3$, when correct skew positioning has been achieved, the carriage translating motor 40 is driven to effect lateral edge positioning. The system senses a sensor transition at time $t_5$ and then moves back to the location at which the transition took place by the time $t_6$. Thus at $t_6$, skew positioning, lateral edge positioning and longitudinal edge positioning is complete.

The velocity profiles for the drive motors 18, 20 and 40 can be derived from lookup tables stored in the microprocessor or derived on the basis of algorithms implemented by the microprocessor. The derivations of such profiles are routine calculations taking into account such parameters as the distance between sensors, the distance between drive rolls, the diameter of the drive rolls and the desired sheet speeds. Such computations and implementation via microprocessor involve the exercise of routine engineering skill and further explanation is unnecessary.

The foregoing registration system has a major advantage over crossed roll registration in that is uses no edge guides. In addition, the registration is software adjustable and does not require tedious adjustment of guiding surfaces within the paper path. In comparisons to previous electronic registration designs, this system reduces paper path distance required and, as a result, allows higher speed operation and/or larger input registration is also improved as a result of near elimination of paper rotation in the registration process. In addition, the control systems necessary have been simplified and the need for a preliminary skewed feed to achieve lateral edge registration is eliminated.

What is claimed is:

1. Apparatus for positioning a sheet in a feed path, comprising:

first and second sheet drive rolls rotatably mounted in the feed path for rotation about respective first and second coaxial axes transverse to the feed path;

means for moving the first and second rolls transversely with respect to the feed path;

first and second drive means for independently rotatably driving the first and second rolls, respectively;

sensor means for detecting the transverse, longitudinal and skew positioning of a sheet in the feed path;

means responsive to detection of the transverse mispositioning of a sheet in the feed path by the sensor means to control movement of the transverse roll moving means;

means responsive to detection of longitudinal mispositioning of a sheet in the feed path by the sensor means for changing the drive speed of the first and second rolls; and means responsive to detection of skew mispositioning of a sheet in the feed path by the sensor means for changing the speed of one roll with respect to the other roll.

2. Apparatus as in claim 1, wherein said sensor means comprises optical sensors.

3. Apparatus as in claim 1, wherein said transverse moving means comprises a stepper motor.

4. Apparatus as in claim 1, wherein the first and second drive means comprise stepper motors.

5. Apparatus as in claim 1, wherein the axis of rotation of the first roll and the axis of rotation of the second roll are coaxial.

6. Apparatus as in claim 1, wherein the transverse moving means comprises a carriage, said first and second rolls being rotatably mounted on the carriage; means mounting the carriage for movement transverse to the direction of feed of sheets in the feed path; and drive means for moving the carriage transversely of the feed path.

7. Apparatus as in claim 6, wherein the transverse drive means comprises a stepper motor.

8. Apparatus as in claim 7, wherein the drive means includes a lead screw and the stepper motor.

9. Apparatus for positioning a sheet in a feed path, comprising:

first and second sheet drive rolls coaxially mounted in the feed path for rotation about axes transverse to the feed path;

first drive means for rotatably driving the first roll at a substantially constant speed;

second drive means for rotatably driving the second roll at variable rates of speed;

means for moving the first and second rolls transversely with respect to the feed path;

sensor means for detecting the transverse and skew mispositioning of a sheet in the feed path;

means responsive to detection of transverse mispositioning of a sheet in the feed path by the sensor means to control movement of the transverse roll moving means; and means responsive to skew mispositioning of a sheet in the feed path by the sensor means for changing the speed of the second roll with respect to the first roll.

10. Apparatus as in claim 9, wherein said sensors comprise optical sensors.

11. Apparatus as in claim 9, wherein said transverse moving means comprises a stepper motor.

12. Apparatus as in claim 9, wherein said second drive means comprises a stepper motor.

13. Apparatus as in claim 9, wherein the axis of rotation of the first roll and the axis of rotation of the second roll are coaxial.

14. Apparatus as in claim 9 wherein the transverse moving means comprises a carriage, said first and second rolls being rotatably mounted on the carriage; means mounting the carriage for movement transverse to the direction of feed of sheets in the feed path drive; and drive means for moving said carriage transversely.

15. Apparatus as in claim 14, wherein the transverse drive means comprises a stepper motor.

16. Apparatus as in claim 15, wherein the drive means includes a lead screw and means rotatably interconnecting the lead screw and the stepper motor.

17. A method of aligning a sheet in a feed path comprising the steps of:

moving the sheet in the feed path;

detecting skew positioning, lateral positioning and longitudinal positioning of the sheet in the feed path; and controlling positioning means including drive rolls for moving the sheet along the feed path in substantially simultaneously correct any lateral mispositioning and longitudinal mispositioning detected during the detecting step, including selectively moving the drive rolls at independently variable speeds and transversely to the feed path.

18. A method as in claim 17, wherein the step of controlling said drive means includes varying the speed of the drive rolls, wherein said drive rolls engage opposed sides of the sheet.

19. A method as in claim 17, and further comprising the step of correcting skew mispositioning of the sheet before correcting lateral and longitudinal mispositioning of the sheet.

* * * * *